US009643194B2

(12) United States Patent
Wohr et al.

(10) Patent No.: US 9,643,194 B2
(45) Date of Patent: May 9, 2017

(54) PERFORATED PLATE FOR AN APPLICATION DEVICE AND CORRESPONDING METHOD

(71) Applicant: Durr Systems GmbH, Bietigheim-Bissingen (DE)

(72) Inventors: Benjamin Wohr, Eibensbach/Guglingen (DE); Hans-Georg Fritz, Ostfildern (DE)

(73) Assignee: Durr Systems GmbH, Bietigheim-Bissingen (DE)

( * ) Notice: Subject to any disclaimer, the term of this patent is extended or adjusted under 35 U.S.C. 154(b) by 0 days.

(21) Appl. No.: 14/766,457

(22) PCT Filed: Feb. 5, 2014

(86) PCT No.: PCT/EP2014/000309
§ 371 (c)(1),
(2) Date: Aug. 7, 2015

(87) PCT Pub. No.: WO2014/121926
PCT Pub. Date: Aug. 14, 2014

(65) Prior Publication Data

US 2015/0375241 A1 Dec. 31, 2015

(30) Foreign Application Priority Data

Feb. 11, 2013 (DE) ..... 10 2013 002 413

(51) Int. Cl.
*B05B 1/14* (2006.01)
*B05B 1/18* (2006.01)
*B05B 17/00* (2006.01)

(52) U.S. Cl.
CPC ..... *B05B 1/185* (2013.01); *B05B 1/14* (2013.01); *B05B 17/0646* (2013.01)

(58) Field of Classification Search
CPC ..... B05B 1/262; B05B 1/1636; B05B 1/265; B41J 2/1433
See application file for complete search history.

(56) References Cited

U.S. PATENT DOCUMENTS 4,472,329 A * 9/1984 Muschelknautz ..... C03B 37/06 264/12
5,255,017 A 10/1993 Lam
(Continued)

FOREIGN PATENT DOCUMENTS

DE 69123224 T2 6/1997
DE 4021661 C2 3/1999
(Continued)

OTHER PUBLICATIONS

International Search Report and Written Opinion for PCT/EP2014-000309 mailed Jun. 16, 2014 (13 pages).

*Primary Examiner* — Davis Hwu
(74) *Attorney, Agent, or Firm* — Bejin Bieneman PLC

(57) ABSTRACT

A perforated plate is provided for an application device for the application of a coating agent, in particular a paint, a sealant, a glue or a separating agent, to a component, in particular to a motor vehicle body component. The perforated plate contains at least one through-hole for passing the coating agent through and a hole exit opening on the side of the perforated plate that is located downstream with a wetting surface that can be wetted during operation by the coating agent. The through-hole, to reduce the wetting tendency, transitions into a protruding pipe stub or has a structure that reduces the wetting tendency and/or improves the flushability, e.g., a microstructuring or a nanostructuring.

22 Claims, 8 Drawing Sheets

(56) References Cited

U.S. PATENT DOCUMENTS

| | | | | |
|---|---|---|---|---|
| 5,405,089 | A * | 4/1995 | Heimann | B05B 1/185 239/533.13 |
| 6,235,177 | B1 | 5/2001 | Borland et al. | |
| 7,264,917 | B2 | 9/2007 | Hu et al. | |
| 7,537,175 | B2 * | 5/2009 | Miura | B05B 1/14 239/589 |
| 7,721,979 | B2 * | 5/2010 | Mazzola | B05B 1/185 239/106 |
| 8,240,583 | B2 * | 8/2012 | Cristina | B05B 1/18 239/533.13 |
| 2001/0013554 | A1 | 8/2001 | Borland et al. | |
| 2003/0029379 | A1 | 2/2003 | Onogawa et al. | |
| 2005/0001884 | A1 | 1/2005 | Hu et al. | |
| 2007/0023547 | A1 | 2/2007 | Borland et al. | |
| 2010/0222752 | A1 | 9/2010 | Collins, Jr. | |
| 2013/0284833 | A1 | 10/2013 | Fritz et al. | |

FOREIGN PATENT DOCUMENTS

| | | | |
|---|---|---|---|
| DE | 102004030640 | A1 | 2/2005 |
| DE | 202011000324 | U1 | 4/2011 |
| DE | 102010019612 | A1 | 11/2011 |
| EP | 0489246 | A2 | 6/1992 |
| EP | 0928637 | A2 | 7/1999 |
| EP | 1275440 | A1 | 1/2003 |
| EP | 2486829 | B1 | 5/2014 |
| WO | 0118280 | A1 | 3/2001 |
| WO | 2010078428 | A1 | 7/2010 |

* cited by examiner

PERFORATED PLATE FOR AN APPLICATION DEVICE AND CORRESPONDING METHOD

CROSS-REFERENCE TO RELATED APPLICATIONS

This application claims priority to Patent Cooperation Treaty Patent Application No. PCT/EP2014/000309, filed on Feb. 5, 2014, which claims priority to German Application No. DE 10 2013 002 413.7, filed Feb. 11, 2013, each of which applications are hereby incorporated herein by reference in their entireties.

BACKGROUND

For painting motor vehicle body components, rotary atomisers, which atomise the paint to be applied using a rotating bell cup, are usually used. Although conventional rotary atomisers are well-suited for painting the full surface of components, the application of stripes or other patterns, and also the coating of partial surfaces therewith is problematic.

It is likewise known to use what are called droplet generators for coating components, as is described for example in DE 10 2010 019 612 A1. Therein, the coating agent to be applied is passed through a perforated plate with numerous through-holes, with a coating-agent jet emerging in each case from the individual through-holes in the perforated plate, the jet breaking up into droplets which then impinge on the component surface to be coated and form there a coherent coating-agent film.

What is problematic about this known droplet generator is the fact that the perforated plate has wetting surfaces at the hole exits which are partially wetted by the emerging coating agent during operation, which prevents the coating-agent jet from being detached from the perforated plate.

Furthermore, with perforated plates according to the prior art there is the problem that the necessary coating-agent volume flow is not achieved because the hole diameters are too small and the thickness of the perforated plate is too great to overcome the pressure loss occurring with coating agents of conventional viscosities. If the thickness of the perforated plate is reduced, it will however lose its mechanical stability.

A nozzle plate for an inkjet printer is known from DE 691 23 224 T2, but this known nozzle plate cannot be used in the field of application technology.

Furthermore, with regard to the prior art reference should be made to EP 0 928 637 A2, DE 10 2004 030 640 A1, DE 20 2011 000 324 U1 and DE 40 21 661 C2.

SUMMARY

The present disclosure includes a perforated plate for an application device for the application of a coating agent, such as, for example a paint, a sealant, a functional layer, or a glue, or a separating agent. The disclosure further includes an application method in which such a perforated plate is used, as well as a novel production method for such a perforated plate.

This disclosure includes the general technical teaching to provide the perforated plate, on the side that is located upstream and/or on the side that is located downstream, with a three-dimensional structuring which reduces the impeding wetting tendency and/or reduces the pressure loss upon flowing through the through-hole.

A perforated plate as disclosed herein can be suitable for an application device for the application of a coating agent, as is described, for example, in DE 10 2010 019 612 A1. The disclosure is, however, not limited to perforated plates for a particular type of application device, but also covers perforated plates which are suitable for other types of an application device. The perforated plate may be suitable for an application device which applies a paint, a sealant, a glue or a separating agent to a component, for example to a motor vehicle body component. With regard to the type of coating agent, the disclosed subject matter is not limited to the above-mentioned examples of coating agents, but can also be realised with other types of coating agents. The category "functional layer" covers layers which result in surface functionalisation, such as for example adhesion promoters, primers or alternatively layers for reducing transmission.

Furthermore, it should be mentioned that the term "coating-agent jet" used in the context of this disclosure covers both continuous coating-agent jets and droplet jets.

The presently-disclosed perforated plate, in keeping with the prior art, has at least one through-hole which serves for passing the coating agent through, with, e.g. a coating-agent jet emerging from the through-hole, which then impinges on the component surface to be coated and there forms a coherent coating-agent film.

The presently-disclosed perforated plate can have on at least one of its sides a three-dimensional structure which reduces the pressure loss of the fluid flowing through and/or reduces the wetting surface on the side of the perforated plate that is located downstream.

When passing the coating agent through the through-hole in the perforated plate, it should be taken into consideration that the side of the perforated plate that is located downstream forms a wetting surface on the periphery of the through-hole, which surface is wetted by the coating agent during operation, which makes it difficult to detach the coating agent. In order to reduce this wetting surface and hence to facilitate detachment of the coating agent from the perforated plate, provision therefore can be made for the through-hole on the side of the perforated plate that is located downstream to transition into a pipe stub which protrudes from the side of the perforated plate that is located downstream, so that only the end face of this pipe stub forms an impeding wetting surface.

Furthermore, the impeding wetting tendency can also be reduced in that the peripheral edge of the hole exit opening, on the side of the perforated plate that is located downstream, has a structuring which reduces the wetting tendency. Such structurings are known per se from the prior art under the heading "Lotus effect", and may for example consist of a microstructuring or a nanostructuring. Such structuring can also improve the flushability of the component.

In the case of the above-mentioned pipe stub, in order to reduce further the impeding wetting surface, provision may be made for the pipe stub to have an outer circumferential surface which tapers, in particular conically, towards the free end of the pipe stub. In such case, the wall thickness of the pipe stub therefore decreases towards the free end of the pipe stub, so that the end face of the pipe stub at the mouth opening of the pipe stub is extremely small, which results in a correspondingly small wetting surface. For example, the wall thickness of the pipe stub at its free end may be smaller than 100 μm, 50 μm, 10 μm or 5 μm.

Furthermore, in the context of the present disclosure there is the possibility of the pipe stub having at its free end that is located downstream a mouth opening which is inclined relative to the longitudinal axis of the pipe stub.

In order to obtain as small as possible a wetting surface of the pipe stub, provision can be made for the pipe stub to have a wall thickness which is smaller than the internal diameter of the through-hole. The wall thickness of the pipe stub can be in the range of 50% to 75% of the internal diameter of the through-hole. In one example, the pipe stub has a wall thickness of at most 100 μm, 50 μm or 30 μm, in order to form a correspondingly small wetting surface on the end face of the pipe stub.

Furthermore, in one example, provision is made for the through-hole to have on the side of the perforated plate that is located upstream a hole inlet opening which is optimised in terms of flow. For example, this optimisation in terms of flow may include a nozzle shape of the hole inlet opening. It is however also possible for the hole inlet opening merely to be rounded off, in order to offer as low a flow resistance as possible.

In the same way, the hole exit opening of the through-hole on the side of the perforated plate that is located downstream can also be optimised in terms of flow, for example in the shape of a nozzle or by rounding-off in order to reduce the flow resistance.

For a nozzle-shaped configuration of the through-hole, the through-hole preferably forms a Laval nozzle, but other nozzle types are also possible.

The through-hole itself can have an internal cross-section which is constant along the longitudinal axis of the through-hole, the internal cross-section in an example being circular.

The internal cross-section may however also be similar to a rectangle or an oval.

However, in the context of the disclosure there is alternatively also the possibility of the internal cross-section of the through-hole changing along its longitudinal axis, in order, for example, to form a nozzle shape. Such a change in the internal cross-section of the through-hole along its longitudinal axis is possible only to a limited extent or with certain restrictions when using conventional production methods (e.g., drilling, milling). If, e.g., the through-hole between the entrance and exit is to be larger than the entrance and exit themselves, the limit of the conventional production methods is reached.

In this case, the pipe stub protrudes only slightly relative to the surface of the perforated plate that is located downstream, for example with a length in the range of 25%-100, 50%-100%, 25%-50% or 25%-75% of the thickness of the perforated plate. Such a length of projection of the pipe stub is sufficient to limit the wetting to the end face at the free end of the pipe stub.

The pipe stub therefore has, between the side of the perforated plate that is located downstream and the free end of the pipe stub, a length which is preferably greater than 10 μm, 20 μm, 50 μm or 100 μm and/or less than 1 mm, 500 μm, 200 μm or 100 μm.

Furthermore, the perforated plate in an example has a large number of through-holes, for example more than 20, 50 or even more than 500 through-holes.

The surface density of the through-holes, the distance between the directly neighbouring through-holes, and the internal cross-section of the through-holes in this case can be dimensioned such that the coating-agent jets emerging from the individual through-holes, after impinging on the component, form a coherent coating-agent film.

It may however also be intended for the coating-agent jets, after impinging on the component, not to mingle with other jets. If this is desired, the distance of the through-holes from each other must be selected according to the coating-agent properties and the necessary volume flow.

Further, it should be mentioned that the through-holes in the perforated plate may either have the same internal cross-section or different internal cross-sections. The same applies to the diameter of the through-hole at the exit. The exit cross-section (diameter) determines the diameter of the coating-agent jet (of the drops) and is therefore far more important than the internal diameter.

Furthermore, there is the possibility of the distance between the directly neighbouring through-holes within the perforated plate being uniform.

Alternatively, there is however also the possibility of the individual through-holes being arranged at different distances from each other or being arranged in regions within which the distances between the through-holes are identical, but are different from region to region.

In an example, the distance between the directly neighbouring through-holes is at least equal to three times, four times or six times the internal diameter of the through-holes.

Furthermore, it should be mentioned that the through-holes may, for example, be arranged at the corners of a polyhedron, such as, for example, at the corners of a triangle, a trapezium or a rectangle.

The internal diameter of the individual through-holes is preferably less than 0.2 mm, 100 μm, 50 μm or even less than 20 μm, which can scarcely be achieved with cutting production methods.

What is problematic about the known droplet generators is the production of the perforated plate, because, for example, cutting production methods (e.g., drilling) allow for only relatively large through-holes with a diameter of at least 50 μm.

Furthermore, in this case the aspect ratio of internal diameter of the through-holes on the one hand and thickness of the perforated plate on the other hand is restricted to an aspect ratio of 1:10, so that an internal diameter merely of at least 50 μm can be achieved for a plate thickness of 0.5 mm.

Furthermore, the production of a large number of through-holes in the perforated plate using cutting production methods (e.g., drilling, milling) is time-consuming and economically risky, since there is the risk that the tool (e.g., drill, milling cutter) will break off when producing the final through-hole, rendering the entire perforated plate worthless.

Further, it should be taken into consideration that cutting production methods always produce burrs which impair the operation of the perforated plate if not removed. In particular with very small through-holes, it is however difficult or even impossible to remove the burrs for production-related reasons.

Furthermore, it should be taken into consideration that upon producing the individual through-holes by piercing and punching processes a material displacement/deformation around the respective through-hole takes place, resulting in corresponding deformation of the perforated plate.

It has therefore been possible to produce through-holes with an internal diameter of less than 50 μm hitherto only in a very time-consuming manner by laser machining with ultrashort pulse lasers.

What is disadvantageous about the known perforated plates for application devices (e.g., droplet generators) is therefore the problematic production in particular of very small through-holes and very small three-dimensional structures.

The presently disclosed perforated plate, therefore, can be produced by etching, in particular by dry etching or wet etching. In such a case, the through-holes may be produced by etching attack on the perforated plate, the other regions of the perforated plate between the through-holes being protected by an etch stop and therefore not being abraded. Etching production methods are known per se for example from the field of semiconductor technology, and do not therefore need to be described in greater detail. The term "etching production of the perforated plate" used in the present context therefore means that at least the through-holes are produced by etching, while the perforated plate itself (i.e. initially without the through-holes) can be provided as a blank.

One advantage of etching production of the perforated plate is the possibility of economic production of a perforated plate with a large number of through-holes, because the production costs in this case are independent of the number of through-holes.

A further advantage of etching production of the perforated plate is that, owing to the production method no burrs are produced, so that costly finishing to remove the burrs can be dispensed with.

Furthermore, with etching production no chippings or other machining residues (e.g., drilling emulsions) which might foul the through-holes are produced or remain.

Further, it should be mentioned as an advantage that with etching production the same surface quality can be obtained on the circumferential surface of the bores as with more readily accessible surfaces.

It should be mentioned as a further advantage that with etching production no action of temperature which may change the material structure takes place on the component. Furthermore, no mechanical load which might cause stresses in the component is exerted on the component.

Finally, etching production of the perforated plate allows the through-holes to be exactly parallel, because all the through-holes are produced at the same time with the same process and because, in contrast to drilling of the through-holes, there is no drill to drift. If, for example, in a first process step of the etching production exposure is completely vertical, all the geometries are etched identically, since the etching attack can be controlled extremely uniformly for example with gas.

In an example, the perforated plate includes at least partially a semiconductor material, such as for example silicon, silicon dioxide, silicon carbide, gallium, gallium arsenide or indium phosphide. The present disclosure, however, with regard to the semiconductor material, is not limited to the above-mentioned examples of semiconductor materials. Furthermore, the perforated plate, in the present context, may also include another material which allows for etching production. Mention may be made here for example of ferrous metals (e.g., steels, high-grade steels and other alloys), non-ferrous metals (e.g., aluminium, molybdenum, tungsten, gold, silver, tin, zinc, titanium, copper and copper alloys), semimetals (e.g., tellurium, boron), transition metals (e.g., nickel and cobalt materials) and ceramics (e.g., zirconium oxide, aluminium oxide).

It has already been briefly mentioned above that etching production of the perforated plate offers the advantage that the through-bores can be oriented exactly parallel. In an example, the through-bores with their longitudinal axes therefore have an extremely low angular deviation from each other or relative to the surface normal of the perforated plate, this angular deviation preferably being less than 1°, 0.5°, 0.01° or even less than 0.001°.

The disclosed subject matter is not, however, limited to etching production methods with regard to the production of the perforated plate, but can also be carried out with conventional production methods. For example, cutting production methods (e.g. drilling, milling), punching or laser drilling can also be used.

Furthermore, a combination of cutting production methods and etching production methods is also possible.

For example, a blank of the perforated plate can initially be machined by cutting, whereupon the through-holes are then produced by etching.

Alternatively, there is also the possibility of the perforated plate initially being produced by etching and then being subsequently additionally machined by cutting.

Further, in the present context there is the possibility of a coating, such as for example an anticorrosion layer or an electrically conductive layer, being able to be applied to the perforated plate on one side or on both sides. Furthermore, the coating may also be a constituent of a sensor or of a logic circuit.

In one variant, the perforated plate has a substantially constant thickness over its entire surface.

In another variant, the perforated plate on the other hand has an external edge with a greater thickness and a central region with the through-holes, the thickness of the perforated plate in the region with the through-holes being less than at the edge. This reduction in the thickness in the region of the through-holes is advantageous because the flow resistance of the through-holes is thereby reduced. The thickness of the perforated plate in the region of the through-holes is therefore preferably less than 1 mm, 0.5 mm or even less than 0.3 mm.

Furthermore, in the present context there is the possibility of the perforated plate having at least one reinforcing strip for mechanical reinforcement, with the perforated plate in the region of the through-holes having a lesser thickness than in the region of the reinforcing strip. For example, the perforated plate may have a thickness of less than 2 mm, 1 mm or 0.7 mm at the edge or at the reinforcing strip.

In addition to the perforated plate which is described above, also included in this disclosure is a complete application device with such a perforated plate.

The perforated plate may in this case for example be a constituent of a nozzle, a nozzle insert, a shaping air ring, a diaphragm, a mixer, a screen, a valve needle or a needle seat.

Further included is an application method which uses an application device with such a perforated plate.

Finally, also included is a corresponding production method for producing such a perforated plate.

For example, the perforated plate in this case may be processed by etching on one side or on both sides.

Furthermore, it should be mentioned in this connection that for example dry etching or wet etching is suitable.

BRIEF DESCRIPTION OF THE DRAWINGS

Other advantageous developments are characterised in the claims, or will be explained in greater detail below with reference to the figures together with the description of examples of embodiments. These show:

FIG. 1 shows a top view of an example perforated plate 1 that can be used, for example, in a droplet generator. With regard to the design details of the droplet generator, reference is additionally made also to DE 10 2010 019 612 A1, so the contents of this patent application should be included in the present description, and are hereby incorporated by reference herein, in their entirety.

The perforated plate 1 has a large number of through-holes 2 which are arranged in the perforated plate 1, the through-holes 2 being arranged in the perforated plate 1 equidistantly and in a matrix.

The perforated plate 1 is distinguished in this case by etching production.

Figure 1:
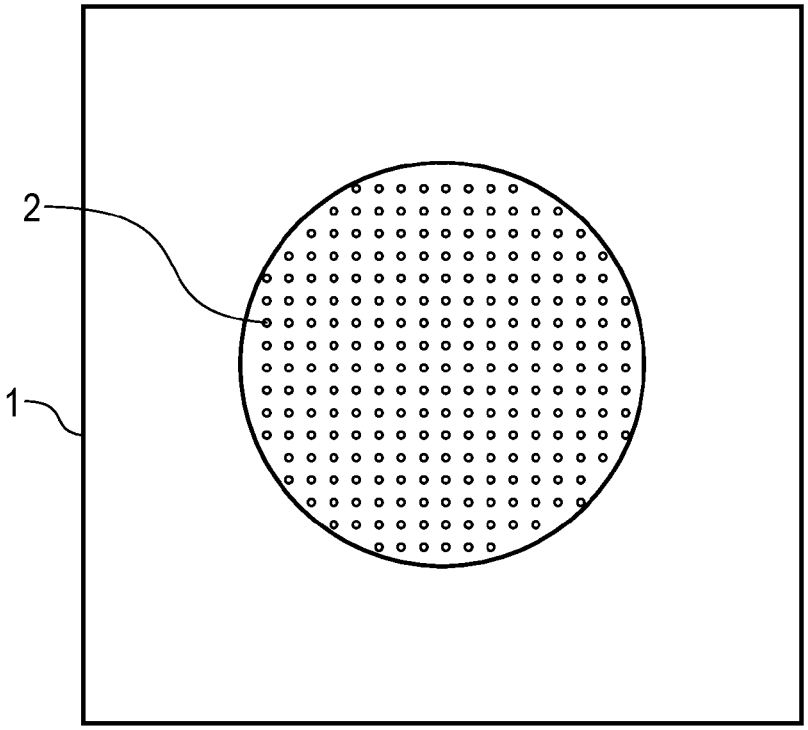
FIG. 1 shows a top view of an example perforated plate.
Figure 2:
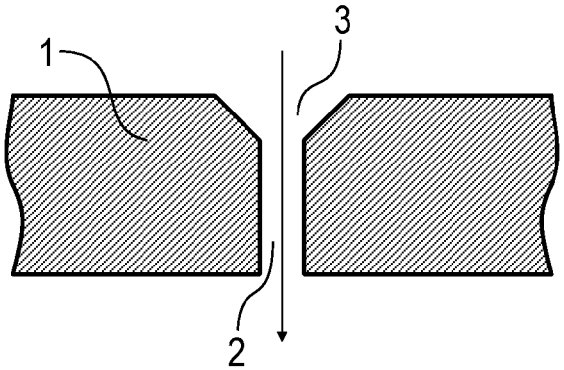
FIG. 2 shows a cross-sectional view through a through-hole in the perforated plate of FIG. 1.

FIG. 2 shows a cross-sectional view through the perforated plate 1 in the region of one of the through-holes 2, the arrow in the cross-sectional view indicating the direction of flow of the coating agent through the through-hole 2. It can be seen from the cross-sectional view that the through-hole 2 has a hole inlet opening 3 which is optimised in terms of flow, which reduces the flow resistance of the through-hole 2.

Furthermore, the perforated plate 1, on the side that is located downstream, on the peripheral edge of the through-holes 2 has in each case a structuring which reduces the wetting tendency.

Figure 3:
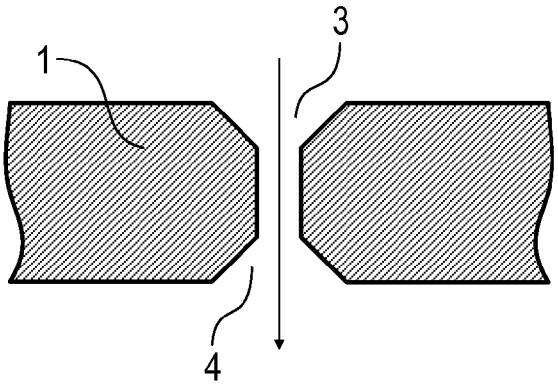
FIG. 3 shows a modification of FIG. 2.

In the example of FIG. 3, the through-hole 2, in addition to the hole inlet opening 3 which is optimised in terms of flow, also has a hole exit opening 4 which is optimised in terms of flow, so that the through-hole 2 forms a Laval nozzle.

Figure 4A:
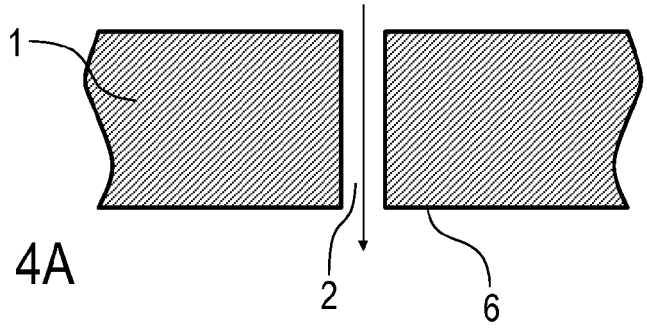
FIG. 4A shows a cross-sectional view through a through-hole in the perforated plate in another variant.
Figure 4B:
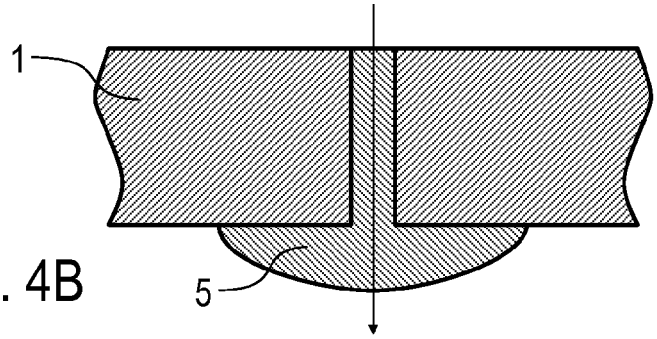
FIG. 4B shows the cross-sectional view of FIG. 4A with coating agent in the through-hole.

FIGS. 4A and 4B show an alternative cross-sectional view through the perforated plate 1 in the region of a through-hole 2, FIG. 4A showing the through-hole 2 without a coating agent, whereas a coating agent 5 is illustrated in FIG. 4B.

It can be seen from this that the coating agent 5 wets a wetting surface 6 on the surface of the perforated plate 1 that is located downstream, which makes detachment of the coating agent 5 from the perforated plate 1 in jet form difficult despite the structuring.

Figure 5A:
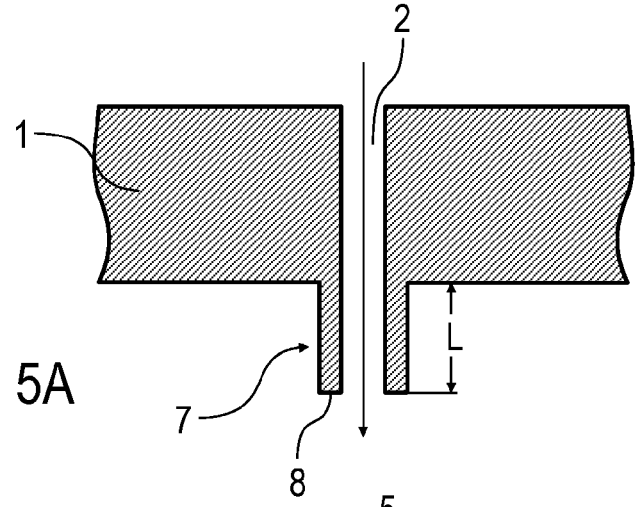
FIG. 5A shows a modification of FIG. 4A with an additional pipe stub in order to reduce the wetting surface.
Figure 5B:
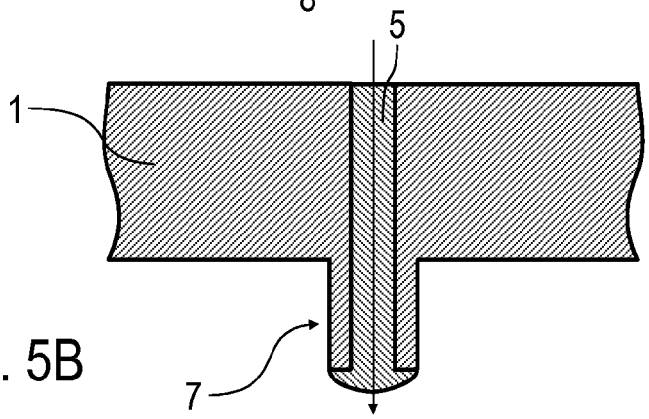
FIG. 5B shows the cross-sectional view of FIG. 5A with coating agent in the through-hole.

FIGS. 5A and 5B show an embodiment with a wetting tendency which is reduced further. For this, the perforated plate 1 has in each case on the peripheral edge of the individual through-holes 2 a pipe stub 7, the through-hole 2 transitioning into the pipe stub 7, so that the end face of the pipe stub 7 forms a wetting surface 8 at the free end of the pipe stub 7. The wetting surface 8 is therefore restricted to the free end face of the pipe stub 7 and hence is considerably smaller than the wetting surface 6 according to FIG. 4A. This facilitates the removal of the coating agent 5 from the perforated plate 1.

The pipe stub 7 in this case protrudes from the surface of the perforated plate 1 that is located downstream with a length L=100 μm.

Figure 6A:
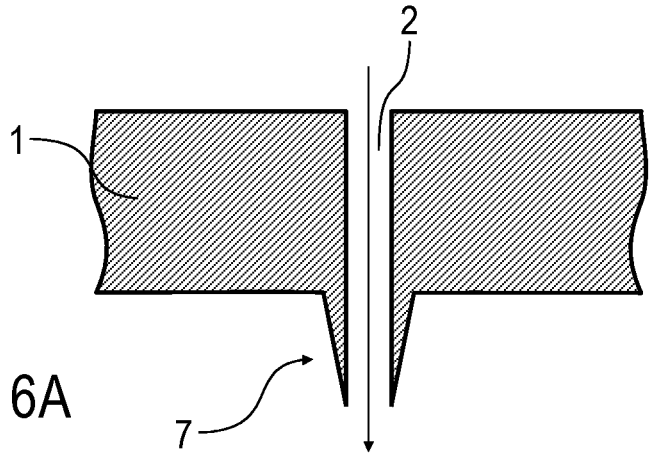
FIG. 6A shows a modification of FIG. 5A with a conically tapering pipe stub.

FIG. 6A shows a modification of FIG. 5A, with the outer circumferential surface of the pipe stub 7 tapering conically to the free end of the pipe stub 7, so that the wetting surface at the free end of the pipe stub 7 is minimal.

Figure 6B:
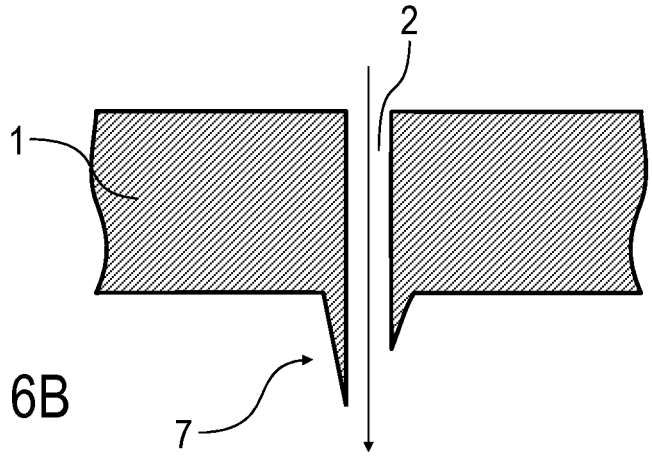
FIG. 6B shows a modification of FIG. 6A with an inclined mouth opening of the pipe stub.

FIG. 6B shows a modification of FIG. 6A, with the mouth opening of the pipe stub 7 being inclined relative to the longitudinal axis of the through-hole 2.

Figure 6C:
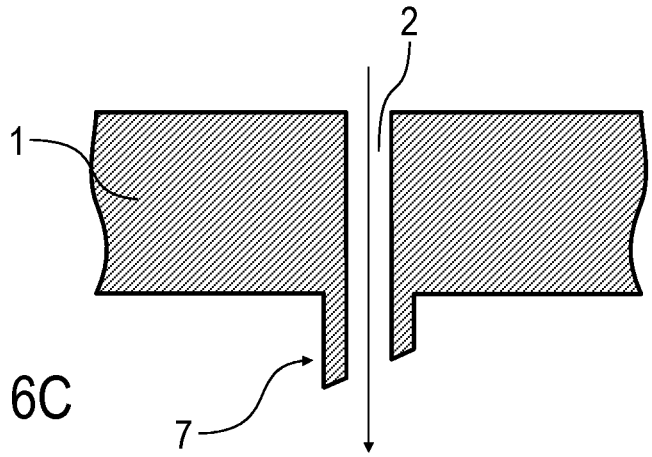
FIG. 6C shows a modification of FIG. 5A with an inclined mouth opening of the pipe stub.

FIG. 6C shows a modification of FIG. 5A, with the mouth opening of the pipe stub 7 being inclined relative to the longitudinal axis of the through-hole.

Figure 7A:
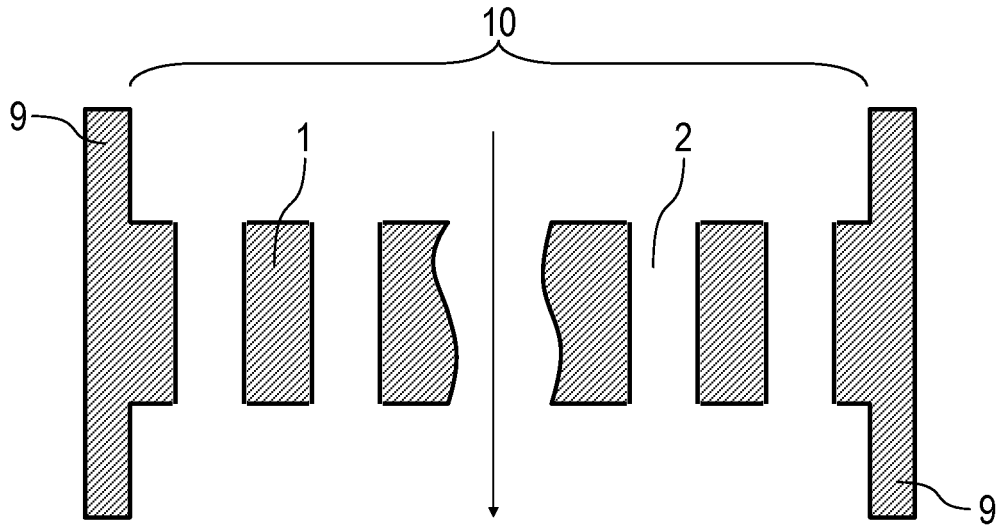
FIG. 7A shows a diagrammatic cross-sectional view through an example perforated plate with a reinforced edge and a thinner central region with the through-holes.

FIG. 7A shows a diagrammatic cross-sectional view through an example perforated plate 1, which partially matches with the perforated plates described above, so reference is made to the above description in order to avoid repetition, with the same reference numerals being used for corresponding details.

One special feature of this example is that the perforated plate 1 has on the outside a relatively thick edge 9 and in the middle a thinner region 10 with the through-holes 2. The thick edge 9 of the perforated plate 1 in this case ensures sufficient mechanical stability, while the reduction in thickness in the region 10 with the through-holes 2 ensures that the through-holes 2 offer only relatively low flow resistance.

Figure 7B:
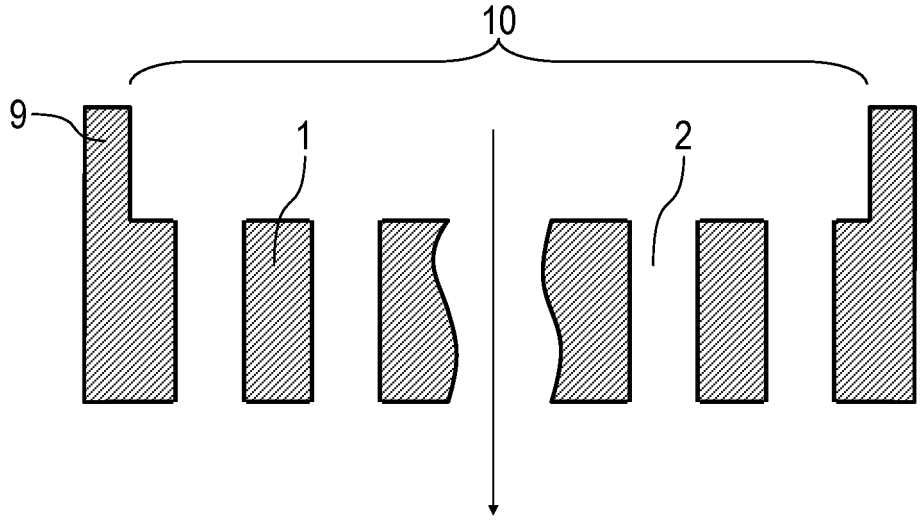
FIG. 7B shows a modification of FIG. 7A.

FIG. 7B shows a modification of FIG. 7A, so reference is made to the description for FIG. 7A in order to avoid repetition, with the same reference numerals being used for corresponding details.

One special feature of this example is that the region 10 in this case is reduced in its thickness only on one side.

Figure 8A:
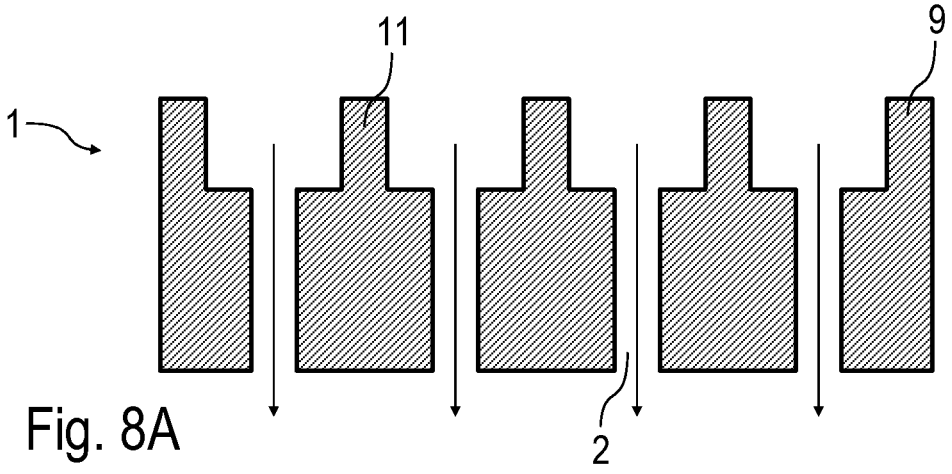
FIG. 8A shows a diagrammatic cross-sectional view through an example perforated plate with reinforcing strip.
Figure 8B:
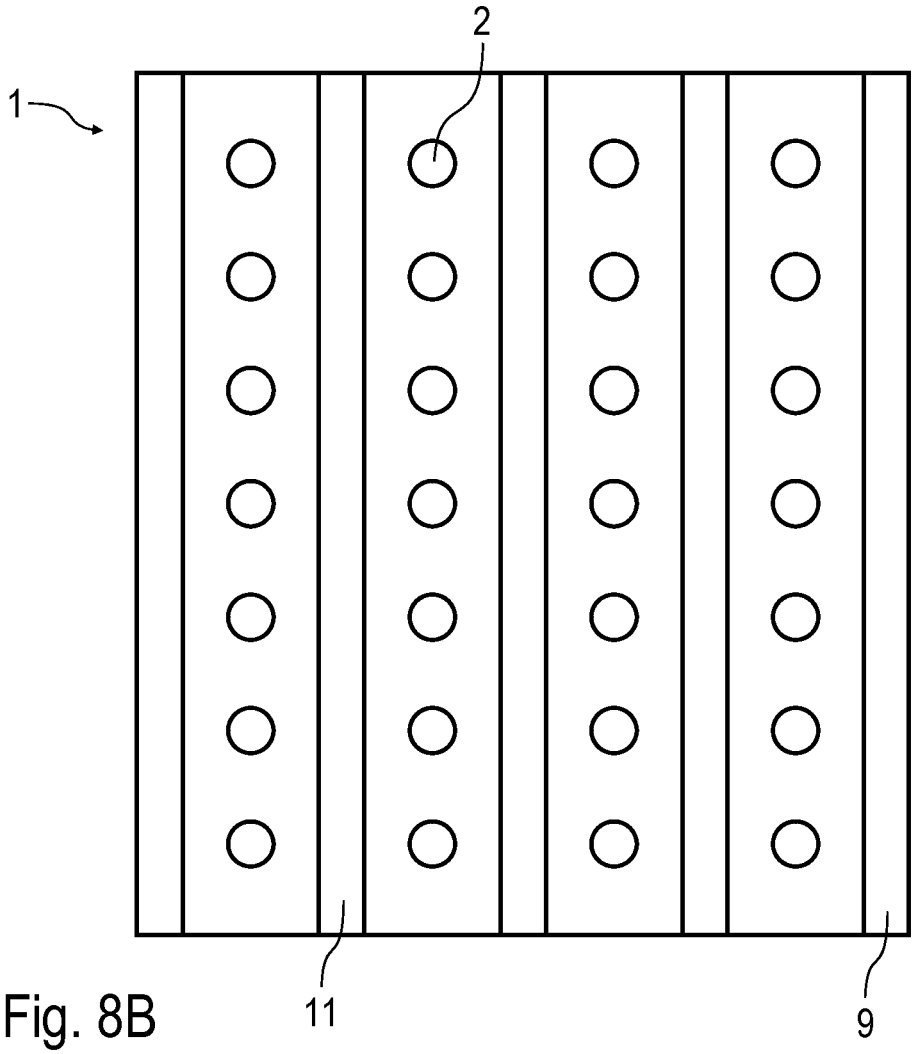
FIG. 8B shows a top view of the perforated plate of FIG. 8A.

FIGS. 8A and 8B show a perforated plate 1, which partially match with the examples described above, so reference is made to the above description in order to avoid repetition, with the same reference numerals being used for corresponding details.

One special feature of this example is that thicker reinforcing strips 11 are also provided in addition to the edge 9 of the perforated plate 1.

The sharp edges and corners shown in the figures are illustrated only by way of example, and may advantageously also be designed to be rounded-off, in order to configure them more optimally in terms of flow or in order to achieve better flushability.

Figure 9:
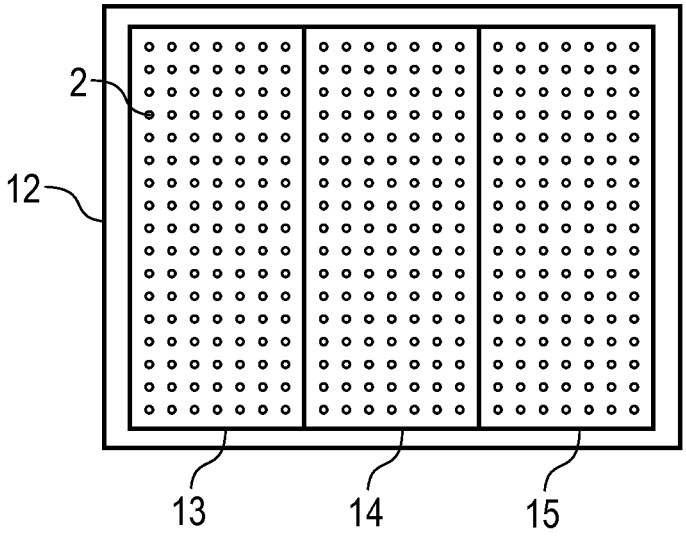
FIG. 9 shows an example insert with a plurality of perforated plates.

FIG. 9 shows a holding mechanism 12 with three perforated plates 13, 14, 15 which directly adjoin one another.

Figure 10:
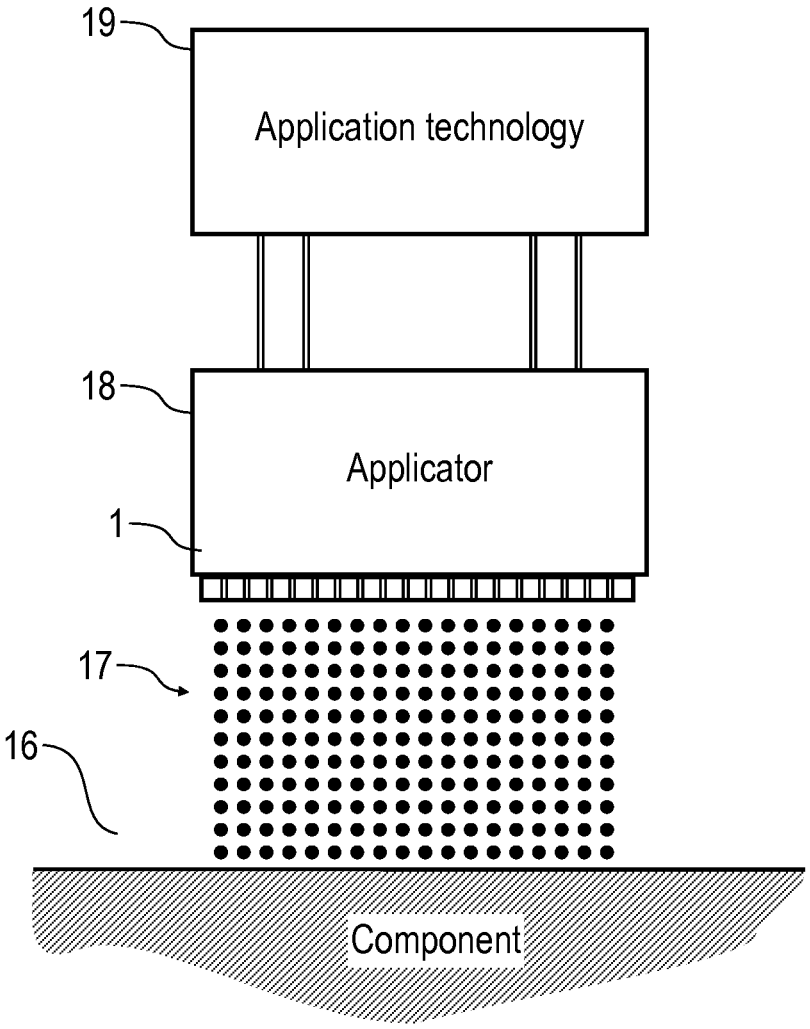
FIG. 10 shows an example application device with an example perforated plate.

Further, FIG. 10 shows, in a greatly simplified diagrammatic representation, an application device with an example perforated plate 1 for coating a component 16 (e.g. a motor vehicle body component).

In this case, coating-agent jets 17 emerge out of the individual through-holes 2 in the perforated plate 1, as is known per se from DE 10 2010 019 612 A1. After impinging on the surface of the component 16, these coating-agent jets 17 form a coherent coating-agent film on the surface of the component 16.

Furthermore, the drawing also shows an applicator 18 connected to the perforated plate 1, and also application technology 19 which is connected to the applicator 18 by diagrammatically illustrated lines.

Figure 11:
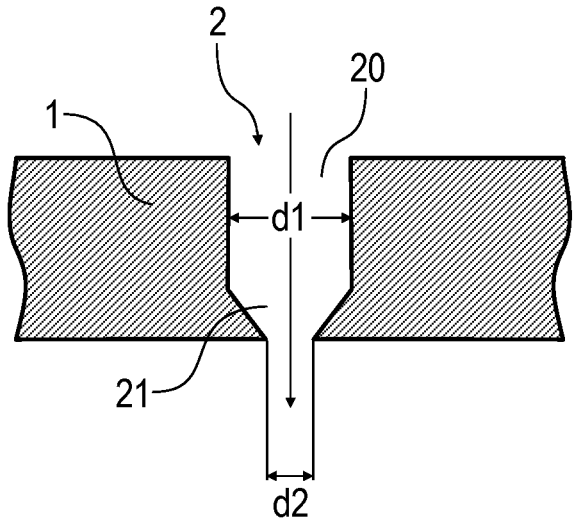
FIG. 11 shows a modification of FIG. 2.

Finally, FIG. 11 shows a modification of FIG. 2, so in order to avoid repetition reference is made to the above description relating to FIG. 2, with the same reference numerals being used for corresponding details.

One special feature of this example of embodiment of the through-hole 2 is that the through-hole 2 initially has a cylindrical region 20 with an internal diameter d1 on the hole inlet opening that is located upstream.

The cylindrical region 20 is then adjoined in the direction of flow by a conical region 21 which tapers in the direction of flow and has an internal diameter d2 at the hole exit opening.

What is important here is that the internal diameter d2 of the hole exit opening is substantially smaller than the internal diameter d1 of the cylindrical region 20.

The invention is not limited to the preferred examples of embodiment described above. Rather, a large number of variants and modifications which likewise make use of the inventive concept and therefore come within the scope of protection are possible. In particular, the invention also claims protection for the subject-matter and the features of the dependent claims independently of the claims referred to. Thus the description also contains design details which are suitable for perforated plates which are not produced by etching.

The invention claimed is:

1. A perforated plate for an application device for the application of a coating agent, to a component the coating agent being one of a paint, sealant, and glue, the perforated plate comprising:

at least one through-hole configured to pass the coating agent through, the through hole having an internal diameter of less than 200 micrometers;

a hole inlet opening on an upstream side of the perforated plate;

a hole exit opening on a downstream side of the perforated plate; and a three-dimensional structuring on at least one of the upstream side of the perforated plate and the downstream side of the perforated plate, the three dimensional structuring having a length of less than 500 micrometers, and a free end that is less than 100 micrometers wherein a wetting tendency is reduced, and, the perforated plate having a thickness of less than 1 millimeter in the region of the through-hole.

2. The perforated plate of claim 1, wherein the structuring comprises a pipe stub that protrudes from the downstream side of the perforated plate into which the through-hole transitions, reducing a wetting surface at the hole exit opening.

3. The perforated plate of claim 2, wherein:

the through-hole forms a Laval nozzle.

4. The perforated plate of claim 1, wherein a cross section of the hole exit opening is one of larger and smaller than a cross-section of the hole inlet opening.

5. The perforated plate of claim 2, wherein the pipe stub has a wall thickness that tapers conically in a direction of flow.

6. The perforated plate of claim 2, comprising at least one of the following features:

the pipe stub has an outer circumferential surface which tapers towards a free end of the pipe stub;

the pipe stub has at its free end that is located downstream a mouth opening that is inclined relative to the longitudinal axis of the pipe stub;

the pipe stub has a wall thickness which is smaller than an internal diameter of the through-hole;

the through-hole has an internal cross-section which is substantially constant along its longitudinal axis;

the pipe stub has a wall thickness of at most 100 micrometers;

the pipe stub between the downstream side of the perforated plate and the free end of the pipe stub has a length in the range from 25%-100% of a thickness of the perforated plate;

the pipe stub between the downstream side of the perforated plate and the free end of the pipe stub has a length that is greater than 10 micrometers and less than 1 millimeter.

7. The perforated plate of claim 1, wherein the perforated plate has more than ten through-holes; and a surface density of the through-holes, distances between the through-holes, and internal cross-sections of the through-holes are dimensioned such that the coating-agent jets emerging from the through-holes, after impinging on the component, form a coherent coating-agent film.

8. The perforated plate of claim 7, wherein the through-holes have substantially a same internal cross-section.

9. The perforated plate of claim 7, wherein the through-holes have different internal cross-sections.

10. The perforated plate of claim 7, further comprising identical distances between directly neighbouring through-holes.

11. The perforated plate of claim 7, further comprising different distances between directly neighbouring through-holes.

12. The perforated plate of claim 1, further comprising at least one of the following features:

the distance between directly neighbouring through-holes is at least equal to three times the internal diameter of the through-holes;

the through-holes are arranged at corners of a polyhedron; and the through-holes are arranged with longitudinal axes parallel relative to each other and have an angular deviation of less than one degree relative to a surface normal of the perforated plate.

13. The perforated plate of claim 1, wherein the at least one through-hole in the perforated plate is produced at least partially by one of the following production methods:

etching; and laser drilling.

14. The perforated plate of claim 1, wherein the perforated plate at least partially is made of a semiconductor material.

15. The perforated plate of claim 1, further comprising a coating of the perforated plate on at least on side of the perforated plate.

16. The perforated plate of claim 15, the coating being at least one of a constituent of a sensor, and a constituent of a logic circuit.

17. The perforated plate of claim 1, wherein the perforated plate has one of a substantially constant thickness, and, at an edge, a greater thickness than in a central region that includes the through-holes.

18. The perforated plate of claim 1, wherein the perforated plate in a region including the through-holes has a thickness of less than one millimeter.

19. The perforated plate of claim 1, wherein the perforated plate has at least one reinforcing strip, the perforated plate in a region of the through-holes having a lesser thickness than in a region of the reinforcing strip.

20. The perforated plate of claim 19, wherein the perforated plate at least one of an edge and the reinforcing strip has a thickness of less than two millimeters.

21. An application device for the application of a coating agent to a component, the coating agent being one of a paint, sealant and glue, the application device comprising at least one perforated plate, the perforated plate comprising:

at least one through-hole configured to pass the coating agent through, the through-hole having an internal diameter of less than 200 micrometers;

a hole inlet opening on an upstream side of the perforated plate;

a hole exit opening on a downstream side of the perforated plate; and a three-dimensional structuring on at least one of the upstream side of the perforated plate and the downstream side of the perforated plate, the three dimensional structuring having a length of less than 500 micrometers and a free end that is less than 100 micrometers wherein a wetting tendency is reduced, and the perforated plate having a thickness of less than 1 millimeter in the region of the through-hole.

22. The application device of claim 21, wherein the perforated plate is a constituent of one of the following components:

a) nozzle,
b) nozzle insert,
c) shaping air ring,
d) diaphragm,
e) mixer,
f) screen,
g) valve needle,
h) needle seat.

* * * * *